US006094497A

United States Patent [19]

Mohler

[11] Patent Number: 6,094,497

[45] Date of Patent: Jul. 25, 2000

[54] LOUDSPEAKER SYSTEM HAVING BACK PRESSURE EQUALIZATION

[75] Inventor: David S. Mohler, Westminster, Colo.

[73] Assignee: Lucent Technologies Inc., Murray Hill, N.J.

[21] Appl. No.: 09/289,012

[22] Filed: Apr. 9, 1999

[51] Int. Cl.[7] ..... H04R 25/00

[52] U.S. Cl. ..... 381/386; 381/189; 381/391; 381/433

[58] Field of Search ..... 381/386, 391, 381/395, 87, 86, 332, 398, FOR 151, FOR 165, 189, 397, 433; 181/150, 171, 172, 199

[56] References Cited

U.S. PATENT DOCUMENTS 3,909,530 9/1975 Gosswiller ..... 381/391
3,995,125 11/1976 Cypser ..... 381/391

*Primary Examiner*—Huyen Le

*Attorney, Agent, or Firm*—Duft, Graziano & Forest, P.C.

[57] ABSTRACT

The loudspeaker system having back pressure equalization apparatus functions to minimize the mismatch between the forward sound wave and the reverse sound wave that is generated by the loudspeaker by rotating the apertures that are formed in the basket to be in alignment with the corners of the enclosure. This rotation causes sound wave reflections within the loudspeaker enclosure at angles at other than 90 degrees to thereby redirect the acoustic reflections within the enclosure away from the back side of the loudspeaker cone. These reflections are also more likely to be absorbed by the sound absorbing material that is mounted on the inside of the enclosure rather than causing perturbations in the cone. In addition, the back edge of the baffle is releaved using a bevel, radius or other contour or apertures formed in the baffle to prevent the blocking of the basket apertures by the baffle. To increase the rigidity of this structure, the releaving/aperture can be selectively included to align with the basket apertures and no releaving/aperture is provided where the basket rib and mounting points are located.

6 Claims, 3 Drawing Sheets

LOUDSPEAKER SYSTEM HAVING BACK PRESSURE EQUALIZATION

FIELD OF THE INVENTION

This invention relates to loudspeaker systems and, in particular, to a loudspeaker system that contains a loudspeaker mounting arrangement that functions to minimize the mismatch between the forward sound wave and the reverse sound wave that is generated by the loudspeaker.

PROBLEM

It is a problem in loudspeaker systems to provide an enclosure and loudspeaker mounting arrangement that minimizes the mismatch between the forward sound wave and the reverse sound wave that is generated by the loudspeaker. The loudspeaker generates equal amplitude and opposite phase sound waves via the vibration of the loudspeaker cone. The reverse sound wave is propagated into the loudspeaker enclosure and present loudspeaker systems suffer from reflections of the sound waves in the speaker enclosure and obstructions to the propagation of the reverse sound wave which cause distortions in the audio output.

A loudspeaker system comprises one or more enclosures that function to house one or more loudspeakers. The enclosure functions to protect the loudspeakers and also provides or houses an acoustic chamber that regulates the quality of the audio output. A loudspeaker consists of a transducer (termed "drive element" herein) that functions to convert electrical signals to an audio output. The drive element typically comprises a magnetic motor structure that vibrates in response to the applied electrical signals to produce an audio output. A cone, dome or flat piston (collectively termed "cone" herein), which is fabricated from paper, plastic, or composite materials, is positioned juxtaposed to the drive element and functions to amplify the audio output that is generated by the drive element. This apparatus is supported by a frame element that is termed a "basket," which functions to support the drive element, align elements contained within the drive element, enclose and protect the fragile cone. The basket is typically mounted on a baffle, which has a hole formed therein to enable the generated audio output to be transmitted from the speaker enclosure.

Most loudspeaker systems utilize a six-sided enclosure to damp the reverse sound wave from the drive elements. The six-sided enclosures conventionally use flat surfaces that are formed from ⅜" to 1" particle board, MDF or plywood. Two and three way loudspeaker systems presently dominate the industry and function to divide the audio output range of the loudspeaker system into audio segments, each of which are produced by a corresponding loudspeaker contained within the loudspeaker system. Tweeters are the high frequency loudspeakers that typically have sealed backs to prevent their reverse sound wave from being adversely effected by the larger loudspeakers which produce the mid range and low range or bass range audio output. Most mid range and bass range loudspeakers vent their backwave into the enclosure. The mid range loudspeaker may use a "box within a box" enclosure within the enclosure to prevent its reverse sound wave from being adversely effected by the bass range loudspeaker.

Most mid range and bass range loudspeakers incorporate a cast or stamped basket that is formed with a plurality of apertures. The basket functions to support the drive element on the baffle and hold the drive element in alignment with the loudspeaker cone. A plurality of apertures are formed in the basket in an attempt to equalize the reverse sound wave with that of the forward sound wave to create a more equal radiation impedance, while maintaining structural rigidity to support the magnetics and keep the drive element in alignment with the loudspeaker cone. Larger apertures formed in the basket do a better job at equalizing the reverse sound wave but can compromise the rigidity of the loudspeaker. Most drive elements make some attempt to vent the reverse sound wave into the enclosure with the size and placement of the apertures in the basket being determined according to the size of the drive element and the material selected to fabricate the basket. Higher quality drive elements for mid range and bass range loudspeakers also feature a vented pole piece to allow the reverse sound wave generated by the magnetic system to be vented.

Two problems exist with the standard use of a typical mid range or bass range loudspeaker. First, a significant portion of the aperture formed in the basket is blocked by the thickness of the baffle. Second, most baskets contain four apertures and the reverse sound wave that is radiated into the enclosure aligns at close to right angles with the walls of the enclosure, which forces strong reflections that return to the cone and cause perturbations in the audio output.

SOLUTION

The above described problems are solved and a technical advance achieved by the present loudspeaker system having back pressure equalization apparatus. This loudspeaker system functions to minimize the mismatch between the forward sound wave and the reverse sound wave that is generated by the loudspeaker by rotating the apertures that are formed in the basket to be in alignment with the corners of the enclosure. This rotation causes sound wave reflections within the loudspeaker enclosure at angles at other than 90 degrees to thereby redirect the acoustic reflections within the enclosure away from the back side of the loudspeaker cone. These reflections are also more likely to be absorbed by the sound absorbing material that is mounted on the inside of the enclosure rather than causing perturbations in the cone. In addition, the back edge of the baffle is releaved using a bevel, radius or other contour or apertures formed therein to prevent the blocking of the basket apertures by the baffle. To increase the rigidity of this structure, the releaving/aperture can be selectively included to align with the basket apertures and no releaving/aperture is provided where the basket rib and mounting points are located.

DETAILED DESCRIPTION

Figure 3:
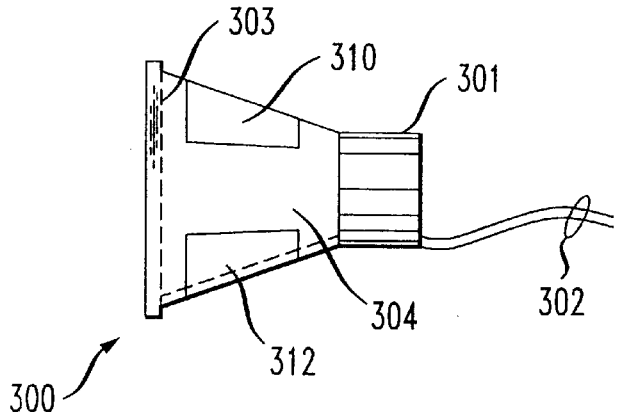
FIG. 3 PRIOR ART
FIG. 3 illustrates a side plan view of a typical prior art loudspeaker.
Figure 4:
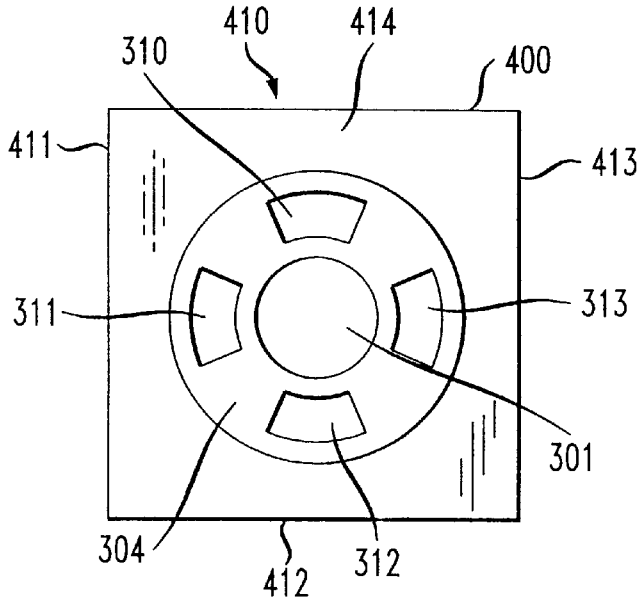
FIG. 4 PRIOR ART
FIGS. 4 and 5 illustrate side and rear plan cross-section views, respectively of the typical prior art mounting arrangement of a loudspeaker in an enclosure.
Figure 5:
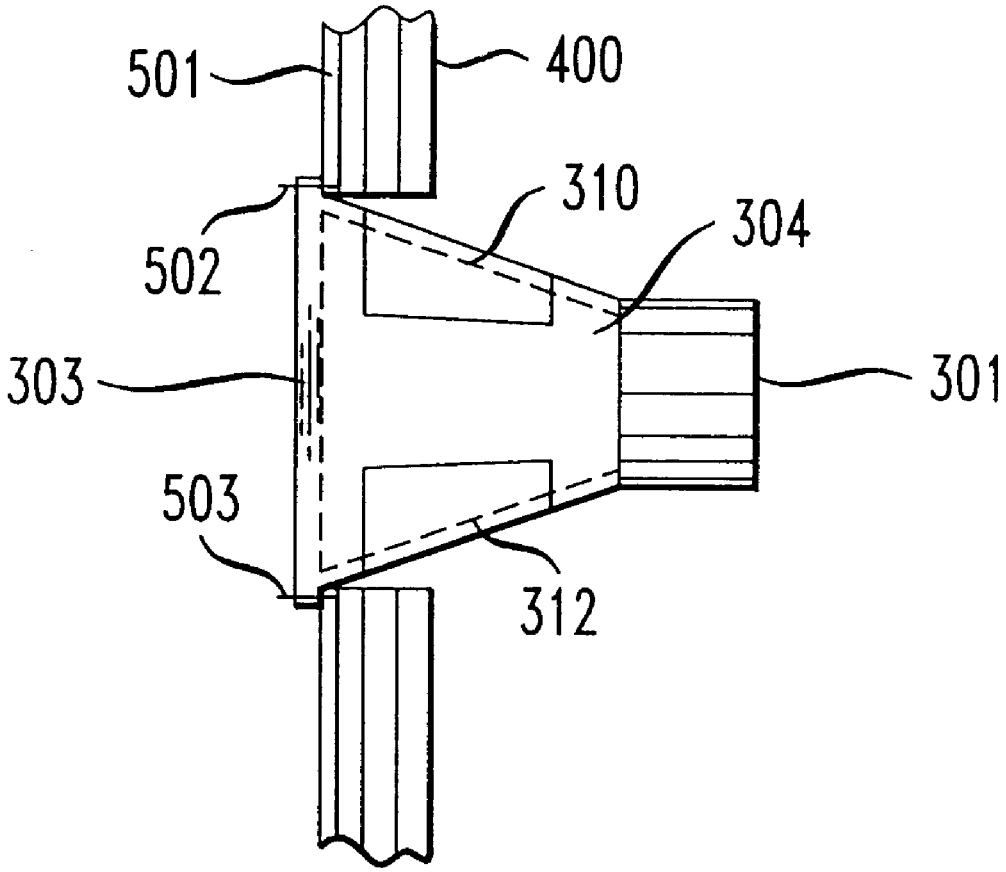
FIG. 5 PRIOR ART

FIG. 3 illustrates a side plan view of a typical prior art loudspeaker while FIGS. 4 and 5 illustrate side and rear plan cross-section views, respectively of the typical prior art mounting arrangement of a loudspeaker in an enclosure. A loudspeaker system comprises an enclosure 400 that functions to house a plurality of loudspeakers. The enclosure 400 functions to protect the loudspeakers and also provide or house acoustic chambers that regulate the quality of the audio output. A loudspeaker 300 consists of: a drive element 301 that functions to convert electrical signals received on a set of conductors 302 to an audio output. The drive element 301 typically comprises a magnetic motor structure that vibrates in response to the applied electrical signals to produce an audio output. A cone 303, which is fabricated from paper, plastic, or composite materials, is positioned juxtaposed to the drive element 301 and functions to amplify the audio output that is generated by the drive element 301. This apparatus is supported by a frame element 304 that is termed a "basket," which functions to support the drive element 301, align elements contained within the drive element 301, enclose and protect the fragile cone 303. The basket 304 is typically mounted on a baffle 501, which has a hole formed therein to enable the generated audio output to be transmitted from the speaker enclosure 400. The basket 304 is secured to the baffle 501 by means of fasteners 502, 503, such as screws, bolts and the like. There is optionally interposed between the baffle 501 and the basket 304 a flexible seal (not shown) comprising an adhesive(s) to provide an air seal and functions to absorb vibration of the basket 304.

The basket 304 functions to support the drive element 301 on the baffle 501 and hold the drive element 301 in alignment with the loudspeaker cone 303. A plurality of apertures 310–313 are formed in the basket 304 in an attempt to equalize the reverse sound wave with that of the forward sound wave to create a more equal radiation impedance, while maintaining structural rigidity to support the magnetics and keep the drive element 301 in alignment with the loudspeaker cone 303. Larger apertures formed in the basket 304 do a better job at. equalizing the reverse sound wave but can compromise the rigidity of the loudspeaker 300. Most drive elements 301 make some attempt to vent the reverse sound wave into the enclosure with the size and placement of the apertures 310–314 in the basket 304 being determined according to the size of the drive element 301 and the material selected to fabricate the basket 304. Higher quality drive elements 301 for mid range and bass range loudspeakers also feature a vented pole piece to allow the reverse sound wave generated by the magnetic system to be vented.

The loudspeaker enclosure is typically in the form of a box-like enclosure, having four sides 410–413 that extend from the front face 414 of the enclosure 400 to join with a back side (not shown) to form the speaker enclosure. The loudspeaker enclosure 400 resonates and therefore the interior of the loudspeaker enclosure 400 has a nonlinear frequency response and may include sound absorbing or damping material. The baffle 501 is mounted to or an integral part of the front face 414 of the speaker enclosure 400 and may cover a significant portion of the apertures 310–313. The reverse sound wave generated by the speaker cone 303 is 180° out of phase with the forward sound wave, but the typical loudspeaker system has a greater resistance in the reverse direction than the forward direction. Therefore, the acoustic load on the loudspeaker 300 is not equal in both directions and can cause distortions in the audio output that is produced.

Loudspeaker System Having Back Pressure Equalization

Figure 1:
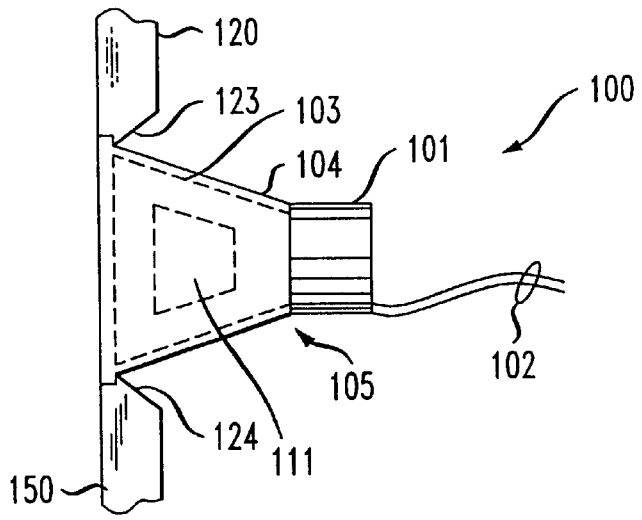
FIGS. 1 and 2 illustrate a side plan cross-section view of the mounting arrangement and a rear plan view, respectively, of the present loudspeaker system having back pressure equalization.
Figure 2:
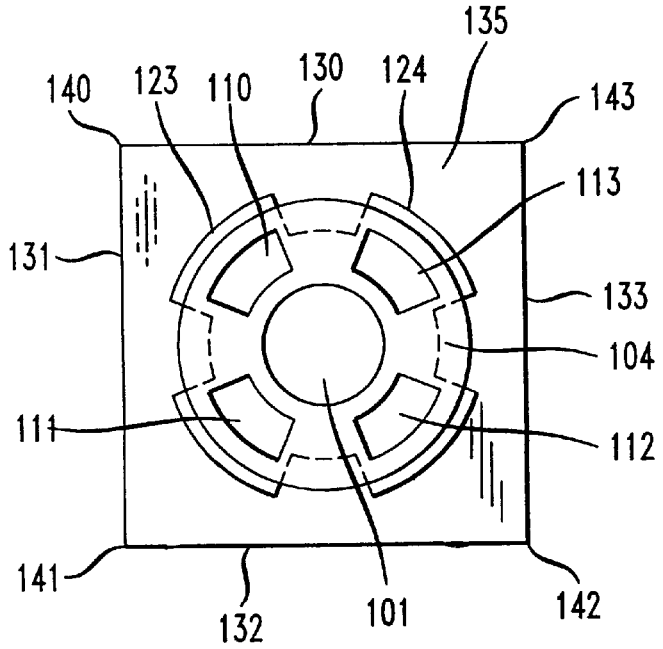

FIGS. 1 and 2 illustrate a side plan cross-section view and a rear plan view, respectively, of the present loudspeaker system 100 having back pressure equalization. As with the loudspeaker system of the prior art as shown in FIGS. 3–5, the present loudspeaker system 100, as shown in FIGS. 1 and 2, comprises a loudspeaker 105 that consists of a drive element 101 that functions to convert electrical signals received on a set of conductors 102 to an audio output. The drive element 101 typically comprises a magnetic motor structure that vibrates in response to the applied electrical signals to produce an audio output. A cone 103, which is fabricated from paper, plastic, or composite materials, is positioned juxtaposed to the drive element 101 and functions to A amplify the audio output that is generated by the drive element 101. This apparatus is supported by a frame element 104 that is termed a "basket," which functions to support the drive element 101, align elements contained within the drive element 101, enclose and protect the fragile cone 103. The basket 104 is typically mounted on the front side of a baffle 120, which has a hole formed therein to enable the generated audio output to be transmitted from the speaker enclosure 150 without obstruction. The basket 104 is secured to the baffle 120 by means of fasteners 125, 126, such as screws, bolts and the like not shown. There is optionally interposed between the baffle 120 and the basket 104 a flexible seal (not shown) comprising silicone rubber to provide an air seal and functions to absorb vibration of the basket 104. The loudspeaker enclosure 150 is typically in the form of a box-like enclosure, having four sides 130–133 that extend from the front face 134 of the enclosure 150 to join with a back side (not shown) to form the speaker enclosure. The loudspeaker enclosure 400 resonates and therefore the interior of the loudspeaker enclosure 400 has a nonlinear frequency response and may include sound absorbing or damping material. The baffle 120 is mounted to or an integral part of the front face 134 of the speaker enclosure 150.

The loudspeaker system 100 having back pressure equalization apparatus functions to minimize the mismatch between the forward sound wave and the reverse sound wave that is generated by the loudspeaker by rotating the apertures 110–113 that are formed in the basket 104 to be in alignment with the corners 140–143 of the enclosure 150. This rotation causes sound wave reflections within the loudspeaker enclosure 150 at angles at other than 90 degrees to thereby redirect the acoustic reflections within the enclosure 150 away from the back side of the loudspeaker cone 103. These reflections are also more likely to be absorbed by the sound absorbing material (not shown) that is mounted on the inside of the enclosure 150 rather than causing perturbations in the cone 103. In addition, the back edge of the baffle is releaved 123, 124 using a bevel, radius or other contour, or apertures (shown in FIG. 2) formed in the baffle 120 to prevent the blocking of the basket apertures 110–113 by the baffle 120. To increase the rigidity of this structure, the releaving/apertures 123, 124 can be selectively included to align with the basket apertures 110–113 and no releaving/aperture is provided where the basket rib and mounting points are located.

SUMMARY

The present loudspeaker system makes use of a loudspeaker mounting arrangement within the loudspeaker enclosure to minimize the mismatch between the forward sound wave and the reverse sound wave that is generated by the loudspeaker. This is accomplished by reducing the amount of the basket aperture that is blocked by the baffle and by orienting the loudspeaker to direct the reverse sound wave that passes through these apertures into the corners of the loudspeaker enclosure to thereby dissipate their negative effect on the quality of the audio output of the loudspeaker system.

What is claimed:

1. A loudspeaker system comprising:

an enclosure of geometric shape that includes a plurality of walls;

a loudspeaker having a drive element, a cone, and a basket having a first end that supports said drive element and a second end distal from said first end that supports said cone between said second end and said drive element, wherein said basket has formed therein a plurality of apertures; and wherein said loudspeaker is mounted on one of said plurality of walls of said enclosure juxtaposed to an aperture formed in said one of said plurality of walls, said aperture being formed to receive said second end of said basket substantially absent obstruction of said apertures and wherein said apertures that are formed in the basket are positioned to be in alignment with corners of said enclosure.

2. The loudspeaker system of claim 1 wherein said aperture is releaved using a one of the class of recess forms including: bevel, radius or other contour, and aperture to prevent the blocking of said basket apertures by a one of said plurality of walls.

3. The loudspeaker system of claim 1 wherein said enclosure comprises a rectangular structure said apertures that are formed in the basket are positioned to be in alignment with corners of said rectangular structure.

4. A method of fabricating a loudspeaker system comprising an enclosure of geometric shape that includes a plurality of walls, a loudspeaker having a drive element, a cone, and a basket having a first end that supports said drive element and a second end distal from said first end that supports said cone between said second end and said drive element, wherein said basket has formed therein a plurality of apertures, comprising the steps of:

forming an aperture in one of said plurality of walls of said enclosure to receive said second end of said basket substantially absent obstruction of said apertures; and mounting said loudspeaker juxtaposed to said enclosure wherein said apertures that are formed in the basket are positioned to be in alignment with corners of said enclosure.

5. The method of fabricating a loudspeaker system of claim 4 wherein said step of forming comprises:

releaved said aperture using a one of the class of recess forms including: bevel, radius or other contour, and aperture to prevent the blocking of said basket apertures by a one of said plurality of walls.

6. The method of fabricating a loudspeaker system of claim 4 wherein said enclosure comprises a rectangular structure said method comprises:

positioning said apertures formed in the basket to be in alignment with corners of said rectangular structure.

* * * * *